US011554595B2

(12) United States Patent
Habereder

(10) Patent No.: US 11,554,595 B2
(45) Date of Patent: Jan. 17, 2023

(54) FIXING UNIT AND METHOD FOR FIXING A PRINT IMAGE ON A RECORDING MEDIUM

(71) Applicant: Canon Production Printing Holding B.V., Venlo (NL)

(72) Inventor: Andreas Habereder, Dorfen (DE)

(73) Assignee: Canon Production Printing Holding B.V., Venlo (NL)

( * ) Notice: Subject to any disclaimer, the term of this patent is extended or adjusted under 35 U.S.C. 154(b) by 17 days.

(21) Appl. No.: 17/180,333

(22) Filed: Feb. 19, 2021

(65) Prior Publication Data

US 2021/0260895 A1 Aug. 26, 2021

(30) Foreign Application Priority Data

Feb. 20, 2020 (DE) ..... 102020104496.8

(51) Int. Cl.
*B41J 11/00* (2006.01)
*B41M 7/00* (2006.01)

(52) U.S. Cl.
CPC ..... *B41J 11/0024* (2021.01); *B41M 7/009* (2013.01)

(58) Field of Classification Search
CPC .. B41J 11/0024; B41J 11/00222; B41J 15/04; B41J 11/0022; B41M 7/009; B41M 7/0018
See application file for complete search history.

(56) References Cited

U.S. PATENT DOCUMENTS 2,736,106 A * 2/1956 Offen ..... B65H 23/24 242/615.12
4,282,998 A 8/1981 Peekna

FOREIGN PATENT DOCUMENTS

DE 3114056 A1 3/1982
DE 19546311 A1 6/1996
DE 19536304 A1 4/1997

OTHER PUBLICATIONS

German Search Report dated Oct. 18, 2020, Application No. 10 2020 104 496.8.

* cited by examiner

*Primary Examiner* — Bradley W Thies
(74) *Attorney, Agent, or Firm* — The Webb Law Firm

(57) ABSTRACT

A fixer includes a fixing roller around which a recording medium is directed such that the print image to be fixed faces toward the shell surface of the fixing roller. A fixing gap is generated with a gaseous fixing medium between the shell surface of the fixing roller and the recording medium. This advantageously produces an efficient and gentle fixing of the print image.

15 Claims, 4 Drawing Sheets

FIXING UNIT AND METHOD FOR FIXING A PRINT IMAGE ON A RECORDING MEDIUM

CROSS REFERENCE TO RELATED APPLICATIONS

This patent application claims priority to German Patent Application No. 10 2020 104 496.8, filed Feb. 20, 2020, which is incorporated herein by reference in its entirety.

BACKGROUND

Field

The disclosure relates to the fixing of a print image on a recording medium, said print image being printed by a printing device, in particular by an inkjet printing device.

Related Art

A printing device, in particular an inkjet printing device, for printing to a recording medium may comprise one or more print heads respectively having one or more nozzles. The nozzles are respectively configured to eject ink droplets in order to print dots of a print image onto the recording medium. The one or more print heads and the recording medium are thereby moved relative to one another in order to ink dots onto the recording medium at different positions, in particular in different lines, and in order to thus print a print image onto the recording medium.

The print image is dried and/or fixed in a fixing unit. The recording medium may thereby be warmed, for example by a heating saddle, in order to melt the dye particles of the print image and therewith fix them. However, the warming of the recording medium may lead to an alteration of the moisture and therewith, if applicable, to a negative effect on the recording medium.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1*a* illustrates an inkjet printing device according to an exemplary embodiment.

FIG. 1*b* illustrates a dryer or fixer for an inkjet printing device according to an exemplary embodiment.

FIG. 2*a* illustrates a fixer having a fixing roller according to an exemplary embodiment.

FIG. 2*b* illustrates the fixer from FIG. 2*a*, with a supply unit for supplying a gaseous fixing medium, according to an exemplary embodiment.

FIG. 2*c* illustrates the fixer from FIG. 2*a*, with a cooler for cooling the fixed print image, according to an exemplary embodiment.

Figure 1A:
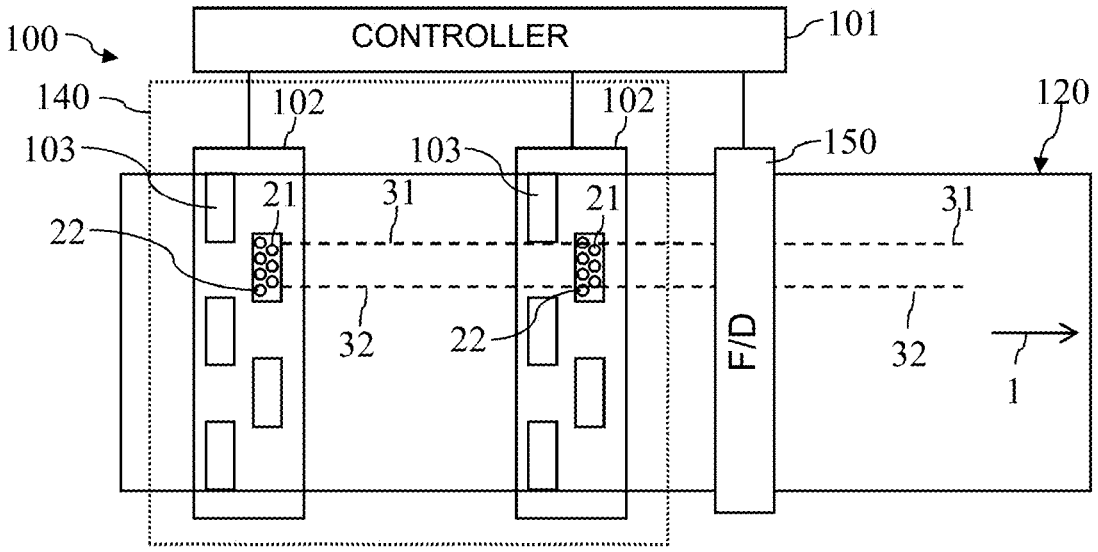

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the present disclosure is to fix a print image on a recording medium in a particularly gentle manner, in particular without alteration of the moisture content of the recording medium.

According to one aspect of the disclosure, a fixer is described for fixing a print image on a printed side of a recording medium. The fixer comprises a fixing roller having a shell surface, wherein the recording medium is directed around the fixing roller such that the recording medium wraps the shell surface of the fixing roller in an arc segment of belt contact; and such that, in the arc segment of belt contact, the printed side of the recording medium faces toward the shell surface. Furthermore, the fixer comprises at least one means for generating a fixing gap made up of a gaseous fixing medium between the shell surface of the fixing roller and the recording medium in the arc segment of belt contact.

According to one aspect of the disclosure, a method is described for fixing a print image on a printed side of a recording medium. The method includes the guiding of the recording medium around a fixing roller such that the recording medium wraps a shell surface of the fixing roller in an arc segment of belt contact; and such that, in the arc segment of belt contact, the printed side of the recording medium faces toward the shell surface. Moreover, the method includes the production of a fixing gap made up of a gaseous fixing medium between the shell surface of the fixing roller and the recording medium in the arc segment of belt contact.

The printing device 100 depicted in FIG. 1*a* is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed through the print group 140 of the printing device 100 along the transport direction 1, which is represented by an arrow.

In the depicted example, the print group 140 of the printing device 100 comprises two print bars 102, wherein each print bar 102 may be used for printing with ink of a defined color, for example black, cyan, magenta, and/or yellow, and if applicable MICR ink. Different print bars 102 may be used for printing with respective different inks. Furthermore, the printing device 100 comprises at least one fixer or dryer 150 that is configured to fix and/or to dry a print image printed onto the recording medium 120.

A print bar 102 may comprise one or more print heads 103 that are arranged side by side in a plurality of rows in order to print the dots of different columns 31, 32 of a print image onto the recording medium 120. In the example depicted in FIG. 1*a*, a print bar 102 comprises five print heads 103, wherein each print head 103 prints the dots of a group of columns 31, 32 of a print image onto the recording medium 120. The number of print heads 103 of a print bar 102 may be 5 or more or 10 or more, for example.

In the embodiment depicted in FIG. 1*a*, each print head 103 of the print group 140 comprises a plurality of nozzles 21, 22, wherein each nozzle 21, 22 is configured to fire or eject ink droplets onto the recording medium 120. A print head 103 of the print group 140 may comprise multiple thousands of effectively utilized nozzles 21, 22, for example, that are arranged along a plurality of rows transverse to the transport direction 1 of the recording medium 120. By means of the nozzles 21, 22 of a print head 103 of the print group 140, dots of a line of a print image may be printed onto the recording medium 120 transverse to the transport direction 1, meaning along the width of the recording medium 120.

In an exemplary embodiment, the printing device 100 also comprises a controller 101, for example a control hardware and/or a processor, that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more functions and/or operations of the controller 101.

The print group 140 of the printing device 100 thus comprises at least one print bar 102 having K nozzles 21, 22, wherein the nozzles 21, 22 may be arranged in one or more print heads 103, and wherein the nozzles 21, 22 may be activated with a defined line timing or with a defined activation frequency in order to print a line traveling transverse to the transport direction 1 of the recording medium 120 onto the recording medium 120 with K pixels or K columns 31, 32 of a print image, for example with K>1000. In the depicted example, the nozzles 21, 22 are installed immobile or fixed in the printing device 100, and the recording medium 120 is directed past the stationary nozzles 21, 22 with a defined transport velocity.

As presented above, the printing device 100 may comprise a dryer or fixer 150 that is configured to dry the recording medium 120 after application of the ink via the one or more print bars 102, and therewith to fix the applied print image on the recording medium 120. The dryer or fixer 150 may thereby be controlled by a controller 101 of the printing device 100. For example, the drying or fixing may take place depending on the quantity of the applied ink and/or depending on a type of the recording medium 120, in particular depending on absorption properties of the recording medium 120 that is used.

Figure 1B:
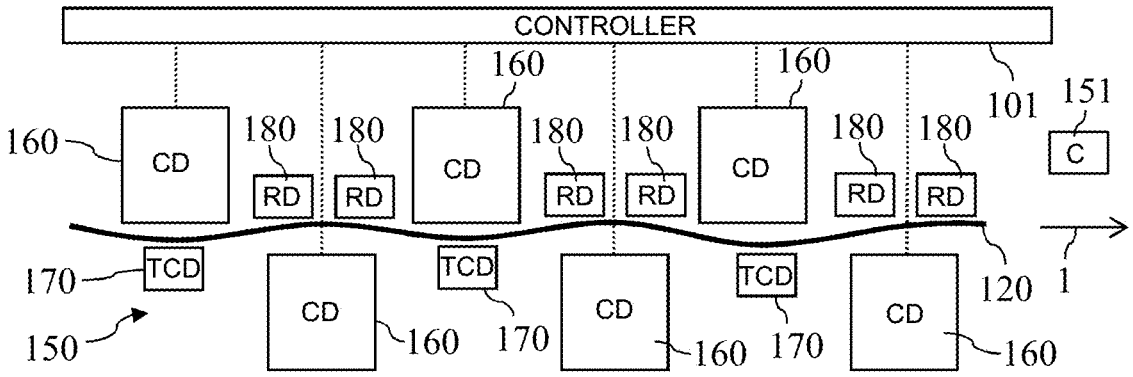

The dryer or fixer 150 depicted in FIG. 1*b* comprises a plurality of drying or fixing modules 160, 170, 180 that are arranged along a drying or fixing route on both sides of the recording medium 120, which recording medium 120 is in the form of a web, for example. In particular, the dryer or fixer 150 may comprise one or more convection dryers 160 that are respectively configured to blow a gaseous drying medium, typically warmed air, onto the surface of the recording medium 120. Furthermore, the dryer or fixer 150 depicted in FIG. 1*b* comprises one or more radiant dryers 180 that are configured to irradiate the print image to be fixed with radiation, for example with infrared radiation. The irradiation leads to a warming of the ink and of the recording medium 120. Moreover, the dryer or fixer 150 depicted in FIG. 1*b* comprises one or more thermal conduction dryers 170 that are configured to warm the recording medium 120 from the (unprinted) back side. A thermal conduction dryers 170 comprises a warmed heating surface or a heating saddle over which or across which the back side of the recording medium 120 is directed in order to warm the recording medium 120.

For example, a heating saddle may thus be used in order to fix the print image on a recording medium 120. The warming of the print image thereby takes place indirectly via the side of the recording medium 120 that is not to be fixed. The recording medium 120 is thus initially warmed before the print image to be fixed is warmed and fixed. Alternatively or additionally, the printed recording medium 120 may be warmed via radiant heat. In this instance as well, a significant warming of the recording medium 120 typically takes place. Alternatively or additionally, a warmed, gaseous drying medium may be blown onto the recording medium 120. This fixing method is relatively effective, but typically requires a relatively long drying route, which in turn leads to a relatively strong warming of the recording medium 120.

The fixing methods depicted in FIG. 1*b* thus typically have the side effect that the recording medium 120 is also warmed in addition to the print image to be fixed. In particular given a paper-based recording medium 120, this may lead to moisture being drawn from the recording medium 120. As a result of this, it may be required that the recording medium 120 is cooled and/or humidified in a subsequent processing step, which is linked with an additional expense and/or with an additional power consumption. Furthermore, the recording medium 120 may possibly be negatively affected by the dehumidification and humidification.

Figure 2A:
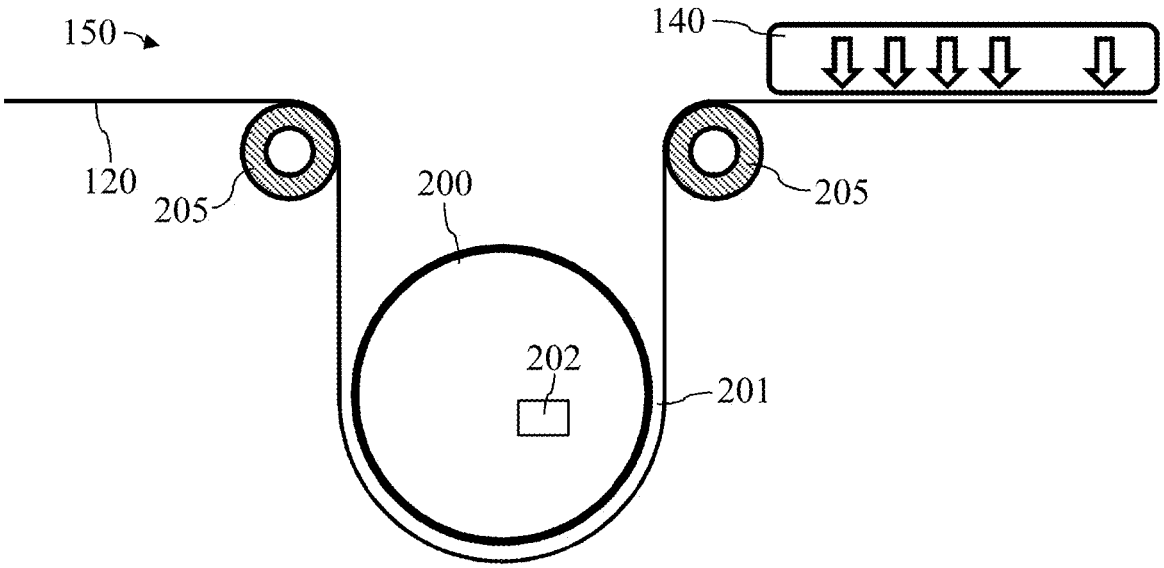
Figure 2B:
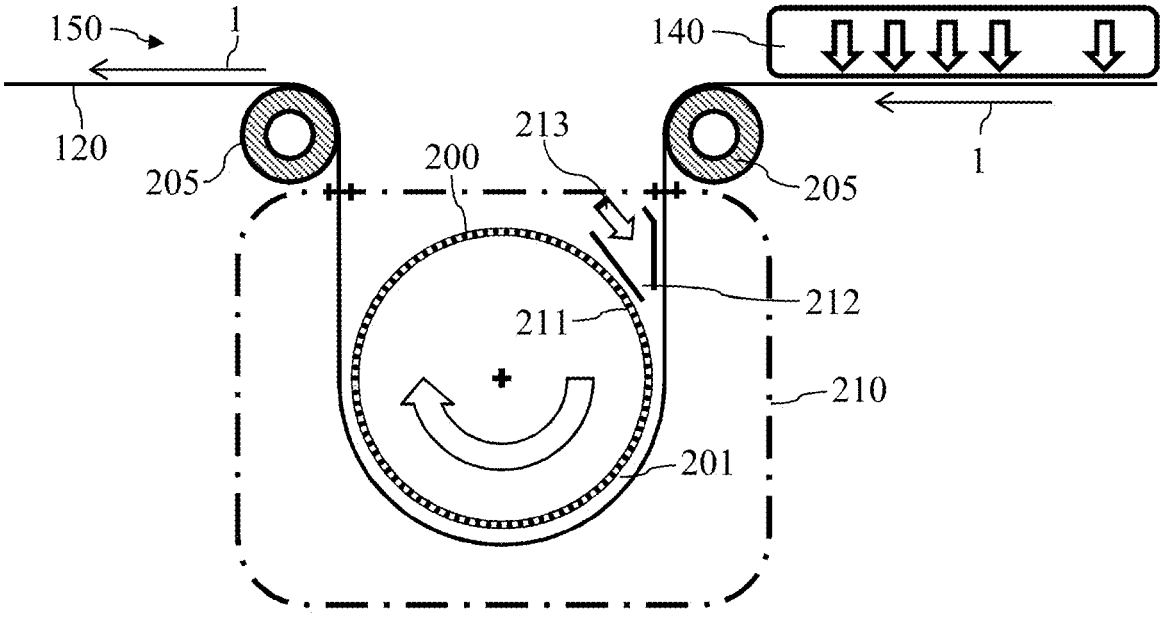
Figure 2C:
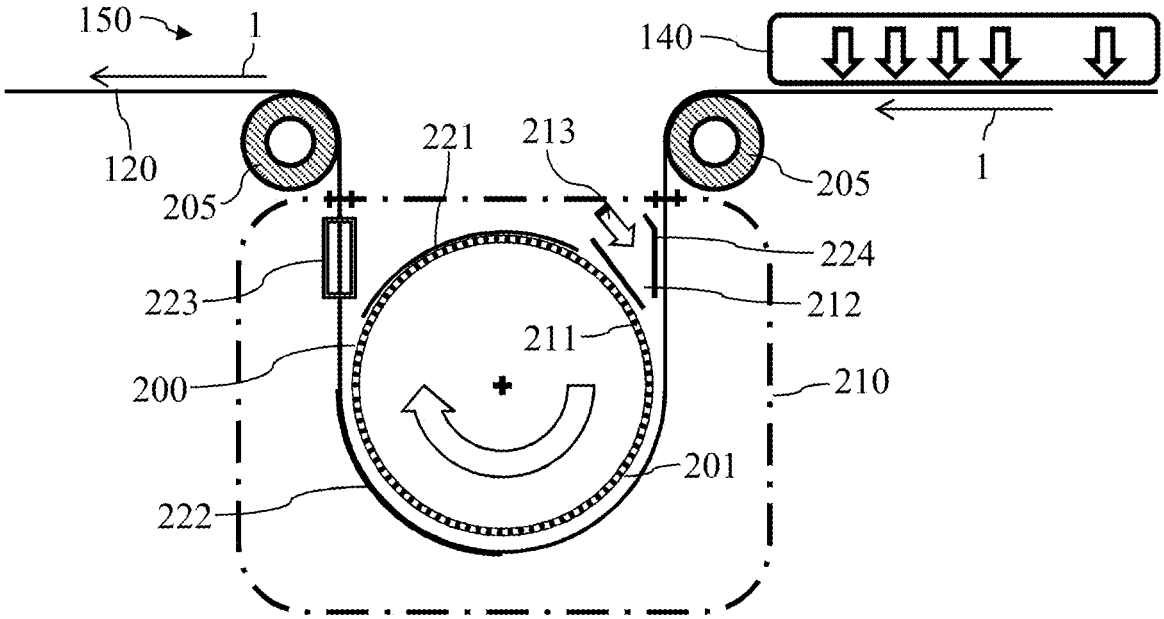

In FIGS. 2*a* through 2*c*, a fixer 150 is depicted that comprises a fixing roller 200 around which the printed recording medium 120 is directed, for example with a wrap of between 150° and 210°, in particular of 180°, as depicted in FIGS. 2*a* through 2*c*. The printed recording medium 120, arriving from the print group 140, is deflected by a deflection roller 205 and directed to the fixing roller 200. The recording medium 120 may be directed back into the original (possibly horizontal) movement direction by an additional, subsequent deflection roller 205.

At the fixing roller 200, the printed side of the recording medium 120, meaning the print image to be fixed, is facing toward the surface of the fixing roller 200. This enables thermal energy to be immediately and/or directly applied to the print image to fix said print image, without the recording medium 120 being thereby significantly warmed. The fixer 150 is designed to form a fixing gap 201 made up of a gaseous fixing medium between the surface of the fixing roller 200 and the recording medium 120, so that the print image on the recording medium 120 does not come into contact with the surface of the fixing roller 200 and is not smeared due to the action of the surface of the fixing roller 200.

FIG. 2*b* shows an example of means with which the fixing gap 201 made up of gaseous fixing medium 213 may be produced. The surface of the fixing roller 200 may have a plurality of openings 211, in particular pores, through which the gaseous fixing medium 213 may be pushed in order to produce the fixing gap 201 made up of gaseous fixing medium 213. Alternatively or additionally, a supply unit (supplier) 212, such as a nozzle, may be arranged at the location at which the deflection of the recording medium 120 as produced by the fixing roller 200 begins, meaning at the entrance to the fixing gap 201, with which supply unit the fixing medium 213 may be blown into the fixing gap 201. The nozzle may have a slit-shaped nozzle opening along the vertical axis of the fixing roller 200, through which nozzle opening the fixing medium 213 is blown. In an exemplary embodiment, the supply unit 212 is a blower, which may include a nozzle in one or more aspects.

The fixing medium 213 has thermal energy with which the print image on the recording medium 120 may be warmed within the fixing gap 201 in order to fix the print image. If applicable, the fixing medium 213 may thereby have a relatively high humidity in order to avoid moisture being drawn from the recording medium 120 within the fixing gap 201.

The fixing roller 200 may be arranged in a housing 210 in which a defined ambient climate may be produced, for example with a defined temperature and/or with a defined humidity. The quality of the fixing may thus be further increased, and/or the negative effect on the recording medium 120 may be further reduced.

In a region of the fixing roller 200, the fixer 150 may have a guide surface 222 that is designed to guide the recording medium 120 at least regionally around the fixing roller 200. For example, the guide surface 222 may be arranged around a portion of the circumference of the fixing roller 200 such that the recording medium 120 travels in a gap between the guide surface 222 and the fixing roller 200. The back side of the recording medium 120, which back side is not to be fixed, may thereby contact the guide surface 222 and be guided around the fixing roller 200 by the guide surface 222 with a defined clearance. By providing a guide surface 222, the stability of the guidance of the recording medium 120 around the fixing roller 200 and/or the stability of the fixing gap 201 may be increased.

If applicable, the guide surface 222 may be climatized, for example in order to cool the recording medium 120, and in order to thereby counteract a warming and/or a dehumidification of the recording medium 120 by the fixing medium 213.

The fixer 150 may be designed to close openings 211 in the shell surface of the fixing roller 200 selectively in at least one segment of the shell surface of said fixing roller 200. The segment of the shell surface that faces away from the fixing gap 201 may thereby be at least partially or entirely closed in order to avoid the fixing medium 213 arriving in this segment through the openings 211. The selective closing of the openings 211 of the shell surface may, for example, be produced by a shield 221, in particular by a shielding plate.

The fixer 150 may be configured to pre-heat the print image and/or the recording medium 120 before reaching the fixing roller 200, for example via a pre-heater 224. The quantity of thermal energy that must be transferred to the print image to fix said print image in the fixing gap 201 may thus be reduced.

Furthermore, the fixer 150 may comprise a cooler 223 that is designed to cool the fixed print image and/or the recording medium 120 after leaving the fixing roller 200. The quality of the fixing may thus be further increased.

Figure 3:
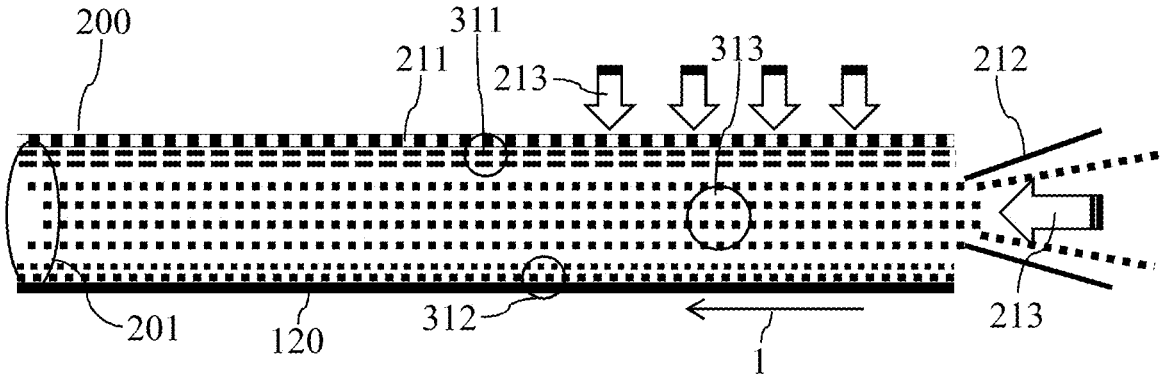
FIG. 3 illustrates different gas layers in the fixing gap between the fixing roller and a recording medium, according to an exemplary embodiment.

An unrolled fixing roller 200 is depicted in FIG. 3. In other words, FIG. 3 shows the circumference of the shell surface of the fixing roller 200 as a horizontal dotted straight line. The interruptions of the straight line thereby represent the openings 211 in the shell surface of the fixing roller 200. Furthermore, FIG. 3 shows the unrolled recording medium 120 and the fixing gap 201 with gaseous fixing medium 213 arranged between the fixing roller 200 and said recording medium 120.

As presented further above, gaseous fixing medium 213 may be pumped into the fixing gap 201 through the openings 211 of the fixing roller 200. Alternatively or additionally, fixing medium 213 may be blown into the fixing gap 201 by a supply unit 212. Due to the rotation movement of the fixing roller 200, a layer 311 of fixing medium 213, entrained by the fixing roller 200, forms directly at the surface of said fixing roller 200. A layer 312 of fixing medium 213, entrained by the recording medium 120, may accordingly form at the moving recording medium 120. Due to the blown-in fixing medium 213, a layer 313 of fixing medium 213 may also be arranged between the layer 311 and layer 312. Layer 313 typically moves through the fixing gap 201 depending on the flow velocity of the fixing medium 213 at the supply unit 212.

A fixer 150 is thus described in which, after application onto the recording medium 120, a print image, for example a film layer, is directed across a drying or fixing roller 200. The print layer is hereby facing toward the fixing roller 200. However, the recording medium 120 does not contact the fixing roller 200 since, via a fixing gap 201, the recording medium 120 is transported without contact with respect to the fixing roller 200. The fixing gap 201 may thereby be produced via the introduction of a possibly climatized gaseous fixing medium 213, for example a gas or a gas mixture, into the intervening space between the surface of the fixing roller 200 and the recording medium 120. The layer 311, 312, 313 of gaseous fixing medium 213 that forms is drawn through the fixing gap 201 by the rotation of the fixing roller 200. The fixing medium 213 may be introduced into the fixing gap 201 via a supply unit 212. Alternatively or additionally, the fixing medium 213 may be introduced into the fixing gap 201 through openings or pores 211 in the surface of the fixing roller 200.

So that a defined fixing gap 201 is present and the recording medium 120 does not touch the fixing roller 200, an overpressure relative to the environment should be present in the fixing gap 201. This may be produced via the gaseous fixing medium 213 deliberately supplied into the fixing gap 201. If applicable, the fixing gap 201 may be stabilized in that the fixing roller 200 has a rotation velocity that is greater than the transport velocity of the recording medium 120. A relative velocity between the recording medium 120 and the surface of the fixing roller 200 may thus possibly be produced in the fixing gap 201 in order to stabilize said fixing gap 201. The rotation direction of the fixing roller 200 is depicted in FIG. 2*b* by an arrow on said fixing roller 200.

If applicable, in order to pre-heat the print image, a pre-heater 224 may be arranged before the actual fixing at the fixing roller 200. Alternatively or additionally, a cooler 223 in order to complete the fixing may be arranged following the fixing.

Furthermore, the fixer 150 may have a guide 222 for the recording medium 120 in order to stabilize the movement of the recording medium 120 at the fixing gap 201. If applicable, portions of the warmed, porous fixing roller 200 may also be covered by one or more shielding plates 221 in order to increase the effectiveness of the fixer 150.

In a preferred example, the fixing roller 200 rotates with a greater velocity relative to the recording medium 120. It may thus be produced that a relatively high quantity of gaseous fixing medium 213 that, for example, is introduced into the fixing gap 201 via the supply 212 may be transported across the fixing roller 200. As a result of this, the temperature of the fixing medium 213 may be kept relatively constant along the entire fixing gap 201 in order to produce an optimally effective fixing of a print image.

By adapting the rotation velocity of the fixing roller 200, and/or by adapting the quantity of fixing medium 213 that is provided to the supply 212, a turbulent and/or laminar flow may be produced in the fixing gap 201. Alternatively or additionally, the flow conditions of the fixing medium 213 in the fixing gap 201 may be influenced by the climatization and/or the quantity of fixing medium 213 that is introduced into the fixing gap 201 through the openings 211 in the surface of the fixing roller 200. A particularly reliable stabilization of the fixing gap 201 may thus be produced.

If applicable, the fixing roller 200 may be operated without rotation given provision of a sufficient quantity of fixing medium 213 through the openings 211 of the fixing roller 200. In this instance, the fixing roller 200 might be replaced by a saddle with openings 211 and/or by a porous saddle. If applicable, the fixing roller 200 may be rotated counter to the transport direction 1 of the recording medium 120.

By encasing the fixer 150 in a housing 210, it is made possible to produce a defined climate within the entire fixer 150. The effectiveness and the quality of the fixing may thus be increased. For example, a climate having a temperature of 80° C. and/or 80% relative humidity may have the effect that a paper-based recording medium 120 dehydrates only relatively slightly. A reduction of the moisture fluctuation, and thereby of the stressing of the recording medium 120, may thus be produced. This may have a positive effect on the flatness of the recording medium 120.

The described drying and/or fixing has a direct effect on the applied print image, which enables a rapid and effective fixing of the print image. Manufacturing costs, installation space, and energy costs of a printing device 100 may thus be reduced. A relatively short drying time may have the effect that the recording medium 120 is only relatively slightly warmed, which enables a gentle and energy-efficient fixing. The quantities of gaseous fixing medium 213 that are required to form the fixing gap 201 are typically relatively small, such that the climatic conditions in the fixing gap 201 may be precisely adjusted. The quality of the fixing may thus be increased, and the recording medium 120 may be preserved. In the event of a paper-based recording medium 120, the waviness, the shrinkage, and the curling may be positively influenced by, for example, a climate having relatively high humidity in the fixing gap 201.

Figure 4:
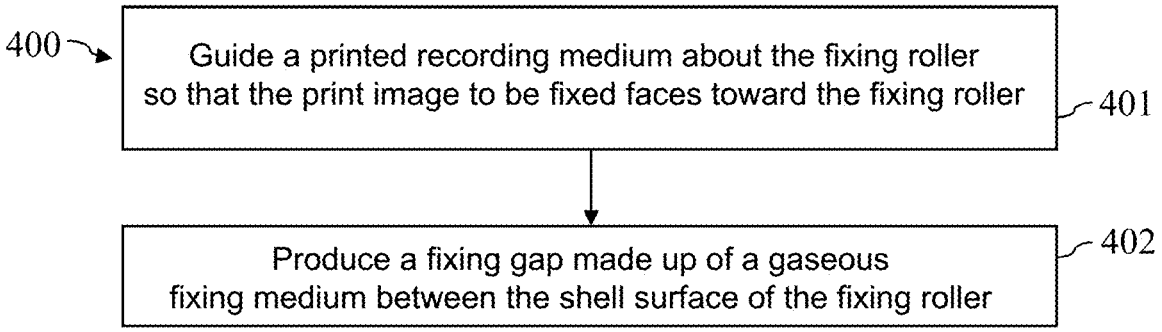
FIG. 4 is a flowchart of a method for fixing a print image on a recording medium according to an exemplary embodiment.

FIG. 4 shows a workflow diagram of an example of a method 400 for fixing a print image on a printed side of a recording medium 120. The fixing may thereby take place after—possibly immediately after—the printing of the print image on the printed side of the recording medium 120. The method 400 may be implemented via a fixer 150 of a printing device 100.

The method 400 includes the guidance 401 of the recording medium 120 around a fixing roller 200 such that the recording medium 120 wraps the shell surface of the fixing roller 200 in an arc segment of belt contact. The arc segment of belt contact may, for example, correspond to an angle range of between 150° and 210° of the circumference of the fixing roller 200. The recording medium 120 is also directed around the fixing roller 200 such that, in the arc segment of belt contact, the printed side of the recording medium 120 is facing toward the shell surface.

Furthermore, the method 400 includes the production 402 of a fixing gap 201 made up of a gaseous fixing medium 213, for example air, between the shell surface of the fixing roller 200 and the recording medium 120 in the arc segment of belt contact. The fixing gap 201 may thereby be designed such that the printed side of the recording medium 120 does not contact the shell surface of the fixing roller 200. The fixing medium 213 may be tempered and/or climatized such that the print image within the fixing gap 201 is fixed, in particular entirely fixed, within the fixing gap 201 via the action of the fixing medium 213. In particular, the temperature of the fixing medium 213, the quantity and/or the volumetric flow of the fixing medium, and/or the transport velocity of the recording medium 120 may thereby be selected such that, in the fixing gap 201, a sufficient amount of thermal energy is transferred from the fixing medium 213 to the print image in order to fix the print image.

Via a direct transfer of thermal energy to the print image to be fixed, the method 400 enables a fixing of the print image onto a recording medium 120 that is efficient, in terms of installation space and energy, and gentle.

In this document, a fixer 150 is thus described for fixing a print image onto a printed side of a recording medium 120, in particular a recording medium 120 in the form of a belt. The recording medium 120 may be moved in a transport direction 1, and in the transport direction 1 the fixer 150 may be arranged after a print group 140 for printing to the recording medium 120. In the print group 140, the print image may have been applied onto one side of the recording medium 120, which therewith becomes the printed side of the recording medium 120.

The fixer 150 comprises a fixing roller 200 having a shell surface. The fixing roller 200 may have a diameter of 50 cm or more, for example. For example, the diameter of the fixing roller 200 may be between 50 cm and 100 cm. The width of the fixing roller 200 may be greater than or equal to the width of the recording medium 120 which travels transverse to the transport direction 1 of the recording medium 120.

The fixer 150 may be designed to guide the recording medium 120 around the fixing roller 200 such that said recording medium 120 wraps the shell surface of the fixing roller 200 in an arc segment of belt contact. The arc segment of belt contact may, for example, correspond to an angle range of between 150° and 210° of the circumference of the fixing roller 200. The recording medium 120 is also guided around the fixing roller 200 such that, in the arc segment of belt contact, the printed side of the recording medium 120 is facing toward the shell surface.

The fixer 150 may comprise at least one deflection roller 205 that is designed to deflect the recording medium 120 in order to have the effect that the recording medium 120 wraps the fixing roller 200 in the arc segment of belt contact. For example, in the transport direction 1 the fixer 150 may have a first deflection roller 205 before the fixing roller 200 and, in the transport direction 1, a second deflection roller 205 after the fixing roller 200. Via the use of one or more deflection rollers 205, it may be particularly reliably and efficiently produced that the recording medium 120 wraps the fixing roller 200.

Furthermore, the fixer 150 comprises at least one means 211, 212 for generating a fixing gap 201 made up of a gaseous fixing medium 213, for example air, between the shell surface of the fixing roller 200 and the recording medium 120 in the arc segment of belt contact. The fixing gap 201 may thereby be designed such that, in the arc segment of belt contact, gaseous fixing medium 213 is always arranged between the shell surface of the fixing roller 200 and the recording medium 120 so that the print image on the printed side of the recording medium 120 does not contact the shell surface of the fixing roller 200.

A fixer 150 is thus described having a fixing roller 200 around which a recording medium 120 is directed such that the print image to be fixed is facing toward the shell surface of the fixing roller 200. A fixing gap 201 with a gaseous fixing medium 213 is generated between the shell surface of the fixing roller 200 and the recording medium 120, in order to produce an efficient and gentle fixing of the print image.

The at least one means 211, 212 for generating the fixing gap 201 is preferably designed to produce a fixing gap 201 with gaseous fixing medium 213 that has a relative humidity of 50% or more, in particular of 75% or more. In a preferred embodiment, the fixing gap 201 has a gap width of between 1 mm and 4 mm. A particularly gentle and/or reliable fixing of a print image may thus be produced.

The fixer 150 has a plurality of parameters with which the quantity of thermal energy that is transferred from the fixing medium 213 to the print image in the fixing gap 201 to fix said print image may be influenced. Examples of parameters are the rotation velocity of the fixing roller 200, the flow velocity of the fixing medium 213 in the fixing gap 201, the transport velocity of the recording medium 120, and/or the temperature of the fixing medium 201. The fixer 150 may be designed to adjust at least one or more of the aforementioned parameters such that, within the fixing gap 201, a sufficient quantity of thermal energy is transferred from the fixing medium 213 to the print image in order to fix the print image on the recording medium 120.

The means 211, 212 for generating the fixing gap 201 may comprise openings 211 in the shell surface of the fixing roller 200 through which gaseous fixing medium 213 is pushed into the fixing gap 201. For example, the fixing roller 200 may have a porous shell surface. The fixing medium 213 may be pushed with a defined pressure through the openings 211, into the intervening space between the shell surface of the fixing roller 200 and the recording medium 120, in order to form the fixing gap 201 made up of fixing medium 213. For example, an overpressure of 0.1 bar or more, or of 0.15 bar or more, may thereby be produced. The fixing medium 213 may be pushed through the openings 211 with a pump. A fixing gap 201 for fixing the print image may be produced especially efficiently and reliably via the use of a fixing gap 200 with openings 211 for the fixing medium 213.

The fixer 150 may be designed such that the escape of gaseous fixing medium 213 through openings 211 in the shell surface is prevented, at least per region, outside of the arc segment of belt contact. In particular, the fixer 150 may comprise a cover device 221, for example a cover plate, that is designed to at least regionally cover and/or seal openings 211 in the shell surface outside of the arc segment of belt contact. The efficiency of the fixer 150 may thus be further increased.

The means 211, 212 for generating the fixing gap 201 may comprise a supply unit 212, in particular a nozzle, that is designed to blow gaseous fixing medium 213 into the fixing gap 201 at the entrance of the arc segment of belt contact, in particular at the entrance with respect to the transport direction 1 of the recording medium 120, between the shell surface of the fixing roller 200 and the recording medium 120. The volumetric flow and/or the quantity and/or the flow velocity of the fixing medium 213 may thereby be adjusted if applicable, in particular in order to produce an optimally stable fixing gap 201. A particularly reliable fixing of a print image may be produced via the use of a supply unit 212.

The fixer 150 may comprise a guide device 222 that is designed to guide the recording medium 120 around the fixing roller 200 in the arc segment of belt contact, at least regionally, from the side of the recording medium 120 that is facing away from the printed side. The guide device 22 may comprise a guide panel, for example. A particularly stable guidance of the recording medium 120 around the fixing roller 200, and as a result of this a particularly reliable fixing, may be produced via the provision of a guide device 222.

The fixer 150 may comprise a drive 202, for example a motor, which is configured to drive the fixing roller 200. The drive 202 may be designed to drive the fixing roller 200 such that the shell surface of the fixing roller 200 and the recording medium 120 move relative to one another in the arc segment of belt contact. In particular, the drive 202 may be designed to drive the fixing roller 20 such that the shell surface of the fixing roller 200 has a higher velocity in the arc segment of belt contact than the recording medium 120. A particularly reliable and efficient fixing of a print image may thus be produced by adjusting the quantity and/or the flow velocity of the fixing medium 213 in the fixing gap 201.

The fixer 150 may comprise a housing 210 that at least regionally or entirely encloses the fixing roller 200. Furthermore, the fixer 150 may have a climatization unit that is designed to adjust a climate within the housing 210, in particular with respect to the temperature and/or the humidity within the housing 210. For example, a temperature of 50° C. or more or of 75° C. or more may be set. Alternatively or additionally, a relative humidity of 50% or more or of 75% or more may be set. The quality of the fixing and/or the preservation of the recording medium 120 may thus be further improved.

The fixing process may be monitored and/or controlled by a controller 151 of the fixer 150. In an exemplary embodiment, the controller 151 includes processor circuitry that is configured to perform one or more functions and/or operations of the controller 151. The controller 151 may be separate from the controller 101, or may be a component of the controller 101.

Furthermore, in this document a printing device 100 is described that comprises the fixer 150 described in this document.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
21, 22 nozzle
31, 32 column (of the print image)
100 printing device
101 controller
102 print bar
103 print head
120 recording medium/substrate
140 print group
150 fixing or dryer
151 processing module (dryer)
160 convection drying module
170 thermal conduction drying module
180 radiant drying module
200 fixer
201 fixing gap
202 drive
205 deflection roller
210 housing
211 opening
212 supply unit (supplier, supply generator)
213 gaseous fixing medium
221 cover device
222 guide device
223 cooler
224 heater
311-313 layer made up of fixing medium
400 method for fixing a recording medium
401-402 method steps

The invention claimed is:

1. A fixer for fixing a print image on a printed side of a recording medium, comprising:

a fixing roller having a shell surface, the fixing roller being configured to receive the recording medium such that the recording medium is guided around the fixing roller and wraps the shell surface of the fixing roller in an arc segment of belt contact, wherein, in the arc segment of belt contact, the printed side of the recording medium faces toward the shell surface; and a supplier configured to generate a fixing gap between the shell surface of the fixing roller and the recording medium in the arc segment of belt contact, the fixing gap including a gaseous fixing medium, wherein the gaseous fixing medium has a relative humidity of 75% or more.

2. The fixer according to claim 1, wherein the supplier configured to push the gaseous fixing medium through openings in the shell surface of the fixing roller and into the fixing gap.

3. The fixer according to claim 2, wherein the fixer is configured to prevent, an escape of the gaseous fixing medium through the openings in the shell surface outside of the arc segment of belt contact.

4. The fixer according to claim 3, wherein the fixer comprises a cover configured to cover and/or close one or more of the openings in the shell surface outside of the arc segment of belt contact.

5. The fixer according to claim 2, wherein the fixer comprises a cover configured to cover and/or close one or more of the openings in the shell surface outside of the arc segment of belt contact.

6. The fixer according to claim 1, wherein the supplier is configured to blow the gaseous fixing medium into the fixing gap, between the shell surface of the fixing roller and the recording medium, at a start of the arc segment of belt contact.

7. The fixer according to claim 1, wherein the fixer comprises a guide configured to guide the recording medium around the fixing roller in the arc segment of belt contact, at least regionally, from a side of the recording medium opposite the printed side.

8. The fixer according to claim 1, wherein the fixer comprises a drive configured to drive the fixing roller such that:

the shell surface of the fixing roller and the recording medium move relative to one another in the arc segment of belt contact; and/or the shell surface of the fixing roller has a higher velocity than the recording medium in the arc segment of belt contact.

9. The fixer according to claim 1, wherein the fixer comprises a drive configured to drive the fixing roller such that:

the shell surface of the fixing roller and the recording medium move relative to one another in the arc segment of belt contact; and the shell surface of the fixing roller has a higher velocity than the recording medium in the arc segment of belt contact.

10. The fixer according to claim 1, wherein the supplier is configured to:

produce the fixing gap having a gap width of between 1 mm and 4 mm.

11. The fixer according to claim 1, wherein the fixer comprises:

a housing that surrounds the fixing roller; and a climate controller that is configured to set a climate within the housing.

12. The fixer according to claim 11, wherein the climate controller is configured to set a temperature and/or a humidity within the housing.

13. The fixer according to claim 1, wherein the fixer comprises at least one deflection roller that is configured to deflect the recording medium to cause the recording medium to wrap the fixing roller in the arc segment of belt contact.

14. A method for fixing a print image on a printed side of a recording medium, the method comprising:

guiding the recording medium around a fixing roller such that:

the recording medium wraps a shell surface of the fixing roller in an arc segment of belt contact, and in the arc segment of belt contact, the printed side of the recording medium faces toward the shell surface; and producing a fixing gap made up of a gaseous fixing medium between the shell surface of the fixing roller and the recording medium in the arc segment of belt contact, wherein the gaseous fixing medium has a relative humidity of 75% or more.

15. A non-transitory computer-readable storage medium with an executable program stored thereon, that when executed, instructs a processor to perform the method of claim 14.

* * * * *